US010994558B2

(12) United States Patent
Bonjoch et al.

(10) Patent No.: US 10,994,558 B2
(45) Date of Patent: May 4, 2021

(54) TEMPORARY FIXATION OF A PORTION OF A PRINTABLE MEDIUM

(71) Applicant: Hewlett-Packard Development Company, L.P., Spring, TX (US)

(72) Inventors: Ignasi Bonjoch, Sant Cugat del Valles (ES); Francisco Javier Roses Conesa, Sant Cugat del Valles (ES); Eduardo Martin Orue, Sant Cugat del Valles (ES); Daniel Nunez Fernandez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/335,416

(22) PCT Filed: Oct. 25, 2016

(86) PCT No.: PCT/US2016/058688
§ 371 (c)(1),
(2) Date: Mar. 21, 2019

(87) PCT Pub. No.: WO2018/080459
PCT Pub. Date: May 3, 2018

(65) Prior Publication Data

US 2020/0023656 A1 Jan. 23, 2020

(51) Int. Cl.
*B41J 11/00* (2006.01)
*B41J 11/70* (2006.01)

(52) U.S. Cl.
CPC ..... *B41J 11/007* (2013.01); *B41J 11/70* (2013.01)

(58) Field of Classification Search
CPC .. B41J 13/0009; B41J 11/001; B41J 11/0045; B41J 15/005; B41J 11/42; B41J 13/0027; B41J 11/70; B41J 11/007; B41J 11/0085; B65H 2511/224
See application file for complete search history.

(56) References Cited

U.S. PATENT DOCUMENTS

| | | | |
|---|---|---|---|
| 5,775,690 | A | 7/1998 | Quesnel et al. |
| 5,904,350 | A | 5/1999 | Creighton et al. |
| 6,055,409 | A | 4/2000 | Richards et al. |
| 6,805,347 | B2 | 10/2004 | Kuramoto |
| 7,975,955 | B2 | 7/2011 | Takeuchi |

(Continued)

FOREIGN PATENT DOCUMENTS

| | | |
|---|---|---|
| CN | 1323700 | 11/2011 |
| CN | 102774145 | 11/2012 |

(Continued)

*Primary Examiner* — Jannelle M Lebron
(74) *Attorney, Agent, or Firm* — HP Inc. Patent Department

(57) ABSTRACT

An apparatus for manipulating a printable medium for the use in a printer is described. The apparatus comprises a drag device, a feed device and a lock device. The drag device conveys the printable medium to a printing area. The feed device feeds the printable medium to the drag device. The lock device is disposed between the feed device and the drag device. The lock device temporarily fixes a first portion of the printable medium so as to cause a second portion of the printable medium being in contact with the drag device to slip along the drag device.

15 Claims, 12 Drawing Sheets

(56) References Cited

U.S. PATENT DOCUMENTS

| | | | | |
|---|---|---|---|---|
| 8,523,317 | B2 | 9/2013 | Bober | |
| 8,905,401 | B2 | 12/2014 | Nakagaki et al. | |
| 2003/0189631 | A1 | 10/2003 | Hoshino et al. | |
| 2005/0156373 | A1 | 7/2005 | Konagaya | |
| 2005/0191109 | A1 | 9/2005 | Takahashi et al. | |
| 2006/0269348 | A1 | 11/2006 | Nagata | |
| 2011/0305490 | A1 | 12/2011 | Richards et al. | |
| 2012/0288318 | A1 | 11/2012 | Nakayama | |
| 2013/0156478 | A1 | 6/2013 | Deno | |
| 2016/0039229 | A1 | 2/2016 | Zhang et al. | |
| 2016/0221781 | A1* | 8/2016 | Yoshida | B65H 9/00 |
| 2016/0289016 | A1 | 10/2016 | Washino | |

FOREIGN PATENT DOCUMENTS

| | | | |
|---|---|---|---|
| CN | 205615185 | | 10/2016 |
| EP | 0734875 | A2 | 10/1996 |
| EP | 0970902 | A2 | 1/2000 |
| JP | 55117444 | | 8/1980 |
| JP | 57049834 | | 3/1982 |
| JP | 05139550 | | 6/1993 |
| JP | H06100209 | A | 4/1994 |
| JP | 06059343 | | 8/1994 |
| JP | 2003146456 | | 5/2003 |
| JP | 2005-200183 | | 7/2005 |
| JP | 2014-121845 | | 7/2014 |
| JP | 2016102012 | | 6/2016 |
| JP | 2016137987 | | 8/2016 |
| RU | 2172258 | C1 | 8/2001 |

* cited by examiner

TEMPORARY FIXATION OF A PORTION OF A PRINTABLE MEDIUM

BACKGROUND

Some printers comprise a printhead having nozzles connected to ink containers. The printhead may move along a direction that is transverse to a feed direction of a printable medium, such as paper. A feed mechanism may feed the printable medium towards a printing zone in which the printhead ejects ink drops onto the printable medium according to the image to be printed.

In some printers, the printhead and the array of nozzles disposed at the printhead is as wide as the page to be printed on the printable medium. The printhead may comprise thousands or tens of thousands of nozzles that are arranged in a pagewide array. This configuration allows for printing on the printable medium without moving the printhead.

BRIEF DESCRIPTION OF DRAWINGS

Some examples are described with respect to the following figures.

DETAILED DESCRIPTION OF DRAWINGS

Examples described herein relate to an apparatus, a printer and a method for manipulating a printable medium.

Figure 1:
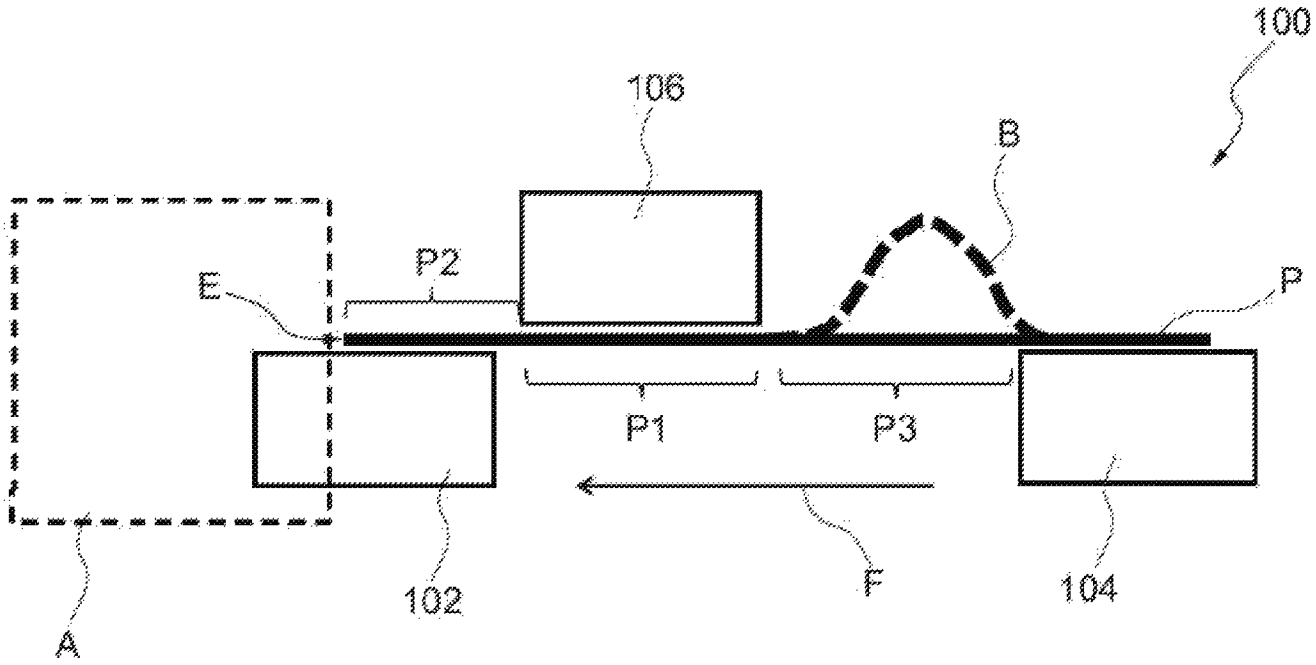
FIG. 1 shows a schematic view of an example of an apparatus.

FIG. 1 shows a schematic view of an example of an apparatus 100. The apparatus 100 comprises a drag device 102, a feed device 104 and a lock device 106. The apparatus 100 can convey a printable medium P to a printing area A. The apparatus 100 may be part of or connected to a printer (not shown).

The printable medium P relates to a physical body on which an image can be printed. Here and in the following, the term image refers to a group of graphical elements that can be displayed on a printed medium. The image may include at least one of texts, letters, characters, numbers, signs, symbols, lines, shapes, drawings, diagrams, and colored areas. Further, the image may determine a page as a unit of the image to be printed on the printable medium. The page may correspond to any known paper size according to internationally known standards, for example, US letter size (8.5 by 11.0 inches) or A4 (210 by 297 millimeters) according to ISO216. The page is, however, not limited to a predefined paper size, but can be arbitrarily defined by a user or by the measures of the image to be printed. In this regard, the terms length and width of the page refer to the dimensions of the page in the feed direction and the direction perpendicular thereto, respectively, of the printable medium P.

The printable medium P is provided in the form of a sheet having a width. For example, the width of the printable medium P is 5 to 100 inches, or 6 to 80 inches, or 8 to 60 inches. The thickness of the printable medium P may be defined by its weight per area. For example, the printable medium P has a weight per area of 20 to 150 g/m$^2$, or 40 to 120 g/m$^2$, or 60 to 100 m$^2$. The printable medium P may be any appropriate material capable of receiving print fluid, such as paper. The printable medium P may comply with certain requirements with respect to the rigidity, bending behavior and the surface smoothness as will be discussed in details below.

The printing area A relates to a zone, an area or a volume in which the image can be printed on the printable medium P. For example, a printhead of a printer is arranged in the printing area A for printing on a portion of the printable medium P therein.

The drag device 102 conveys the printable medium P to the printing area A. For example, the drag device 102 drags or pulls the printable medium P into or through the printing area A. The drag device 102 comprises, for example, rolls or conveyor belts.

The feed device 104 feeds the printable medium P to the drag device 102. The feed device 104 may receive the printable medium P from a printable medium container (not shown) containing the printable medium P. For example, the feed device 104 pushes the printable medium P towards the drag device 102. The feed device 104 comprises, for example, rolls or conveyor belts for conveying the printable medium P.

In particular, the drag device 102 works at a specific drag speed, at which the drag device 102 conveys the printable medium P into or through the printing area A. For example, the drag device 102 conveys the printable medium P at an average drag speed of 0.1 to 20 IPS (inches per second), or 1 to 18 IPS, or 2 to 16 IPS.

In some examples, a passage (not shown) for the printable medium P is provided from the feed device 104 to the drag device 102. For example, the passage may be formed by a bottom plate (not shown) coupled to the drag device 102 and a baffle (not shown) arranged above the bottom plate. The passage may guide the printable medium P from the feed device 104 towards the drag device 102. Such a passage will be described in more details below.

The apparatus 100 may include components capable of guiding the printable medium P along a path including the feed device 104 and the drag device 102. The movement of the printable medium P along the path is discussed herein as the flow, or the feed direction, of the printable medium P, which is indicated by arrow F. In some examples, the apparatus 100 establishes the flow F of the printable medium P from a printable medium container (not shown) to the printing area A. In the following description, the terms "upstream" and "downstream" relate to the flow (feed direction) F of the printable medium P.

The lock device 106 is disposed between the drag device 102 and the feed device 104. The lock device 106 is capable of fixing a first portion P1 of the printable medium P. Fixation the printable medium P or the first portion may refer to preventing the respective printable medium P or a portion thereof from moving towards the printing area A. For example, fixing comprises any appropriate obstruction of flow movement including holding, pressing, grabbing and/or clamping. In some examples, the lock device 106 is moved downwards until abutting on a stop member (not shown), thereby fixing a portion of the printable medium P in between the lock device 106 and the stop member. For this purpose, the lock device 106 itself may be movable, or may comprise a movable member, or both, as will be described in more detail below. Further, the lock device 106 may comprise a housing member for housing a movable member (both not shown).

As long as the lock device 106 fixes the first portion P1 of the printable medium P, a second portion P2 of the printable medium P located downstream of the first portion P1 being in contact with the drag device 102 slips along the drag device 102. Slipping along the drag device 102 may refer to being physically in contact with a moving part of the drag device 102 without being moved by the same. The dragging force exerted of the drag device on the second portion P2 is not sufficient to overcome the fixation force on the first portion P1, which is why the second portion P2 is not pulled into the printing area A.

In some examples, the second portion P2 contains a lead edge E corresponding to an edge of a page that is in front with respect to the feed direction F of the printable medium P. The printer may comprise a printing area sensor device (not shown) for detecting the printable medium P in or just upstream of the printing area A. The printer may initiate the printing process on the printable medium P in response to a detection signal from the printing area sensor device. In some examples, the lock device 106 fixes the first portion P1 of the printable medium P such as to prevent the leading edge E from entering a detectable area of the printing area sensor device.

The printable medium P is accumulated in a region between the feed device 104 and the drag device 102 with the lock device 106 fixing the first portion P1 while the feed device 104 feeds the printable medium P. As a result, a buffer of the printable medium P is created and expanded. A buffer in the form of a buckle B is schematically indicated by dashed lines in FIG. 1. Here and in the following, the terms buckle, bubble or buffer are used interchangeably and associated with the reference sign B.

While the lock device 106 fixes the first portion P1 of the printable medium P, the feed device 104 may continue or start feeding the printable medium P towards the printing area A. Since the printable medium P cannot advance beyond the lock device 106, the printable medium P accumulates in a position upstream of the lock device 106 corresponding to a third position P3. When accumulated, the printable medium P bends according to its materials properties including at least one of rigidity, thickness and surface characteristics. In some examples, the printable medium P forms a curvature in the form of a buckle or a bubble without folding.

Figure 2:
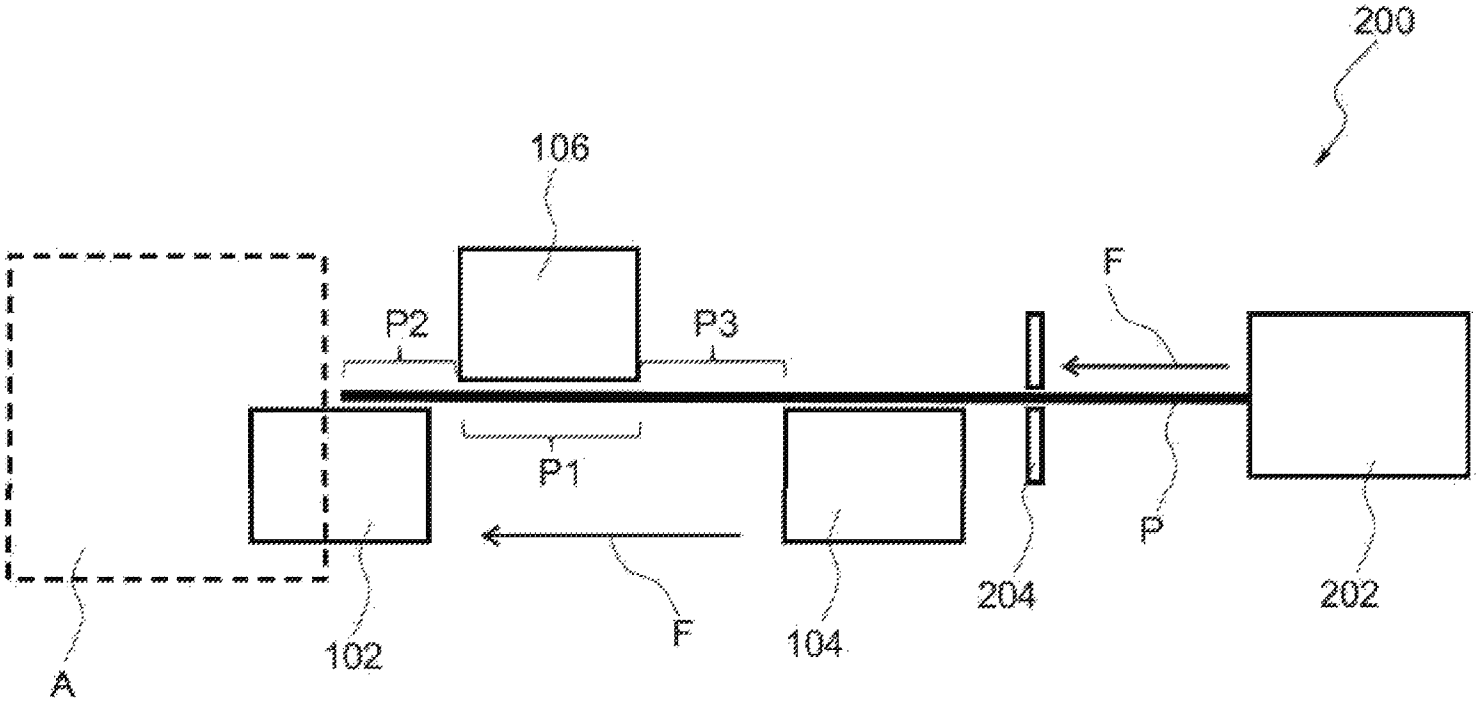
FIG. 2 shows a schematic view of an example of a printer.

FIG. 2 shows a schematic view of an example of a printer 200 for printing on the printable medium P. As implied by the use of the same reference signs, the apparatus 100 as shown in FIG. 1 may be installed in or connected to the printer 200. The printer 200 comprises a drag device 102, a feed device 104 and a lock device 106 including the structural and functional features as described above with respect to the apparatus 100. In addition, the printer 200 comprises a supply device 202 and a cutter device 204. Further, the printer 200 may comprise a control device (not shown).

The printable medium P may be provided as a continuous printable medium, e.g. in the form of a roll of paper. The printable medium P may have a fixed width. The supply device 202 supplies the printable medium P. The supply device 202 may comprise a container to store the printable medium P. Additionally or alternatively, the supply device 202 may comprise a mechanism for delivering the printable medium P to the feed device 104. Accordingly, a flow F, or a feed direction F, of the printable medium P may be established from the supply device 202 to the printing area A.

The cutter device 204 is operable to cut the printable medium P according to the page to be printed. As explained above, the page to be printed may be defined by the image to be printed on the printable medium P. The cutting process may involve any known mechanism for cutting through a sheet of the printable medium P. For example, the cutter device 204 employs a wire saw that is movable in the width direction of the printable medium P. By cutting the printable medium P, a leading edge and a trailing edge are created with respect to the feed direction F of the printable medium P.

If the printable medium P is moved while the cutter device 204 is cutting through the printable medium P, the edges of the page may not be in the desired shape and the page may be deformed. Therefore, the feed device 104 may be stopped while the cutter device 204 is cutting the printable medium P. In the meantime, the drag device 102 pulls the printable medium P into the printing area A, thereby consuming or "deflating" the buffer B. The buffer B may be consumed by the drag device 102 while the feed device 104 is stopped. Between subsequent cutting processes, the feed device 104 is accelerated such that the printable medium P is buffered between the drag device 102 and the feed device 104. The buffering process and the cutting process may be performed alternately.

A threshold value for the length of the page may determine whether or not the lock device 106 is required to fix said first portion P1 of the printable medium P. Here and in the following description, a page to be printed being "short" relates to its length being below a threshold value. The threshold value may depend on or be defined with reference to at least one of the structure and functionality of the apparatus 100. For example, the threshold value may be defined by a distance between the feed device 104 and the drag device 102 and the drag speed of the drag device 102. In particular, the threshold value may correspond to 1.5 to 2.0 times the distance between the feed device 104 and the drag device 102. In some examples, the threshold value is between 10 mm and 1000 mm, or between 100 and 500 mm, or between 200 and 400 mm. According to one example, the threshold value is about 285 mm.

The feed device 104 may be accelerated by a driving motor, e.g. an electric motor having a maximum acceleration. If the page is long as defined above, the feed device 104 can be accelerated sufficiently to create a required amount of buffer B that is dragged into the printing area A by the drag device 102 during the cutting process. In some examples, a single cutting process lasts 1 ms to 1000 ms, or 5 ms to 700 ms, or 10 ms to 300 ms.

If the page is short, i.e. the length of the page to be printed is below a threshold value, the feed device 104 may not be able to accelerate enough for creating the required amount of buffer B. When there is no sufficient amount of buffer B, there may be a risk that the drag device 102 pulls the printable medium P away while it is being cut. This could lead to a deterioration of the page to be printed or a skewing of the printable medium P, or even damage the apparatus 100 or the printer 200.

This problem may be solved by slowing down the drag device 102. However, this solution may reduce the throughput of the printer as well, because the drag device 102 conveys the printable medium P into and through the printing area A and the speed of the drag device 102 hence determines the throughput of the printing process. In addition, the drag device 102 may have a relatively large inertia so that slowing down and accelerating the drag device 102 causes large energy consumption and wear on the moving parts.

The apparatus 100 of FIG. 1 or the printer 200 of FIG. 2 allows for cutting the printable medium P to short pages below the threshold length without the need for slowing down the drag device 102. While the lock device 106 fixes the first portion P1 of the printable medium P, the feed device 104 continues feeding or accelerates to a feed speed, thereby creating and growing the buffer B in a third portion P3 upstream of the lock device 106. Once the buffer B has expanded to a predetermined degree, the lock device 106 may release the first portion P1 and the drag device 102 conveys the printable medium P into the printing area A. The printable medium P is cut by the cutter device 204 while the drag device 102 consumes then buffer B. Accordingly, the predetermined degree of the buffer B may correspond to the amount of buffer consumed during the cutting process. When the buffer B is consumed completely or deflated below a predetermined size, or if the next page to be printed is found to be short, the lock device 106 may operate again to lock a next first portion P1 of the printable medium P. Alternatively or additionally, the lock device 106 may fix the first portion P1 of the printable medium P in response to the cut device 204 cutting the printable medium P.

Hence, in particular when printing short pages, the apparatus 100 or the printer 200 puts the printable medium P on hold instead of slowing down the drag device 102. The drag device 102 can be kept running at the above specified drag speed. Assuming that the inertia of the drag device 102 is large as compared to the inertia of the feed device 104, it is energy saving to drive the feed device 104 at a variable feed speed whereas the drag device 102 is driven at a constant drag speed rather than slowing down and accelerating the drag device 102. Furthermore, the drop of the throughput of a printer may be avoided by maintaining a high drag speed.

A control device (not shown may be provided which controls the feed device 104. The control device may cause the feed device 104 to feed the printable medium P in a discontinuous manner, thereby providing an interruption interval for processing, the printable medium. The interruption interval may correspond to the cutting process, for example, by the cutter device 204. The control device may be part of the printer 200 of FIG. 2 or communicatively coupled to the apparatus 100 of FIG. 1. The control device may be connected to the feed device 104 and to at least one of the cutter device 204 and the lock device 106.

Figure 3:
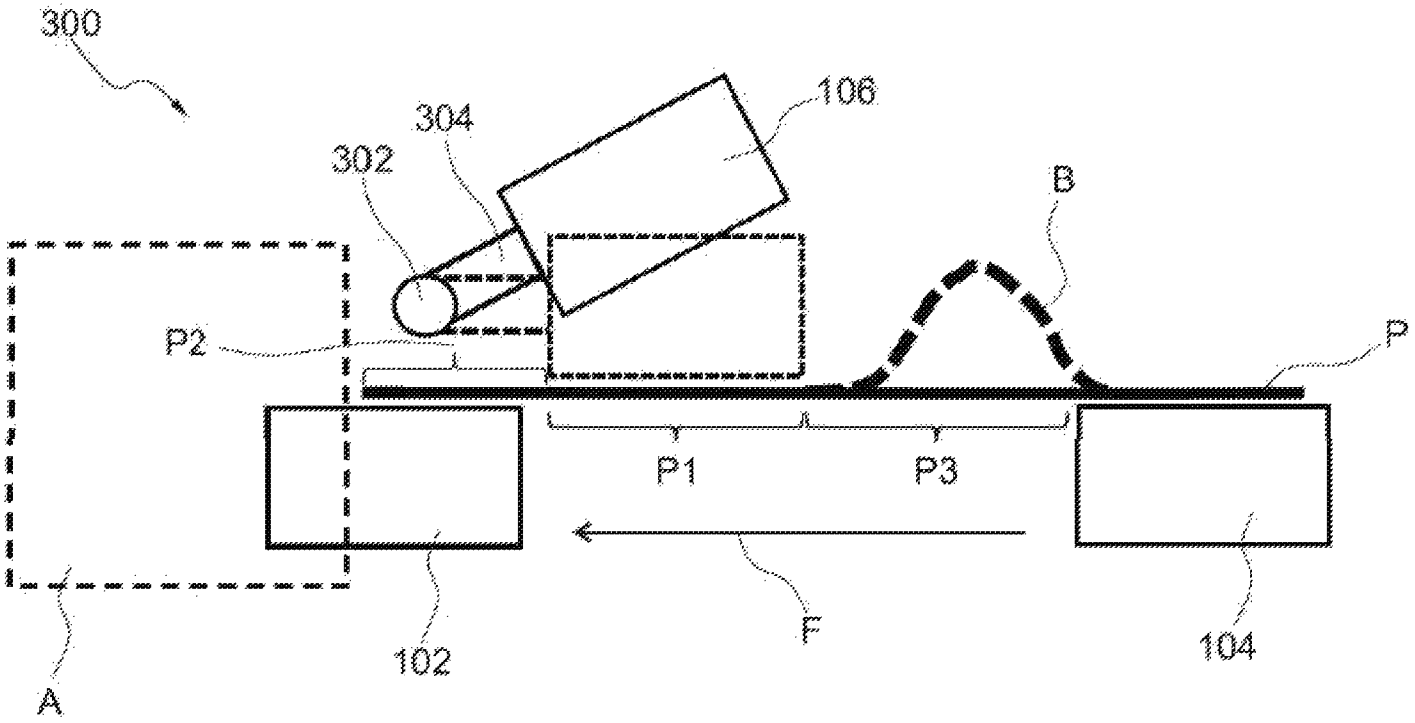
FIG. 3 shows a schematic view of a further example of an apparatus.

FIG. 3 shows a schematic view of another example of an apparatus 300. The apparatus 300 comprises a drag device 102, a feed device 104 and a lock device 106. The structure and functions of the devices 102-106 correspond to those of the apparatus 100 as shown in in FIGS. 1 and 2 and described above. The apparatus 300 additionally comprises a driver shaft 302 for driving the lock device 106. The driver shaft 302 may be connected to the drag device 102, a housing of a printer or a main body of a printer.

The lock device 106 is connected to driver shaft 302 via a support member 304. The lock device 106 may be operatively coupled with the driver shaft 302. The connection between the lock device 106 and the driver shaft 302 may be permanent or releasable. In some examples, the driver shaft 302 comprises a first engagement member, and the lock device 106 comprises a second engagement member (both not shown). The second engagement member of the lock device 106 may be located at the support member 304 which is part of the lock device 106. The first and second engagement members may form a releasable latch connection once they are brought into engagement with each other.

In some examples, the first engagement member of the driver shaft 302 comprises a protruding portion, and the second engagement member of the lock device 106 comprises a recess portion. The recess portion may receive the protruding portion as to establish a connection between the first and second engagement members.

In particular, the protruding portion of the first engagement member may exert a driving torque from the driving shaft 302 to the lock device 106 in order to drive the lock device 106. Accordingly, the torque from a rotary motion of the driver shaft 302 may be transferred to the lock device 106, thereby pivoting the lock device 106 correspondingly.

According to other examples, the driver shaft 302 and the lock device 106 may be connected by any known means or method, including screwing, welding, a connection pin, bayonet coupling, gluing, fusing, etc.

For example, the driver shaft 302 may apply a torque to control the position of the lock device 106. The driver shaft 302 may rotate so as to move the lock device 106. This way, the rotary position of the driver shaft 302 may define the position of the lock device 106. In addition, a stop member (not shown) may be provided which the lock device 106 can abut against in order to fix the printable medium P.

As shown in FIG. 3, the lock device 106 may be connected to the driver shaft 302 via a support member 304 that transfers the torque from the driver shall 302 to the lock device 106. In the example of FIG. 3, the driver shaft 302 rotates clockwise until the lock device 106 is arranged so as to press onto the printable medium P, thereby fixing the first portion P1, as indicated by dashed lines. As a result, a buffer B of the printable medium P is created in a third portion P3 upstream of the lock device 106 upon operation of the feed device 104. This position of the lock device 106 may be referred to as a lock position and correspond to a buffering process of the apparatus 300.

Starting from the lock position, the driver shaft 302 may rotate counter-clockwise in order to release the fixed first portion P1 of the printable medium P, as indicated by solid lines in FIG. 3. As a result, the printable medium P is free to be conveyed into the printing area A by the dragging action of the drag device 102, thereby consuming or, figuratively speaking, "deflating" the buffer B. This position of the lock device 106 may be referred to as a release position and may be associated with a cutting process of a cutter device (not shown).

Figure 4:
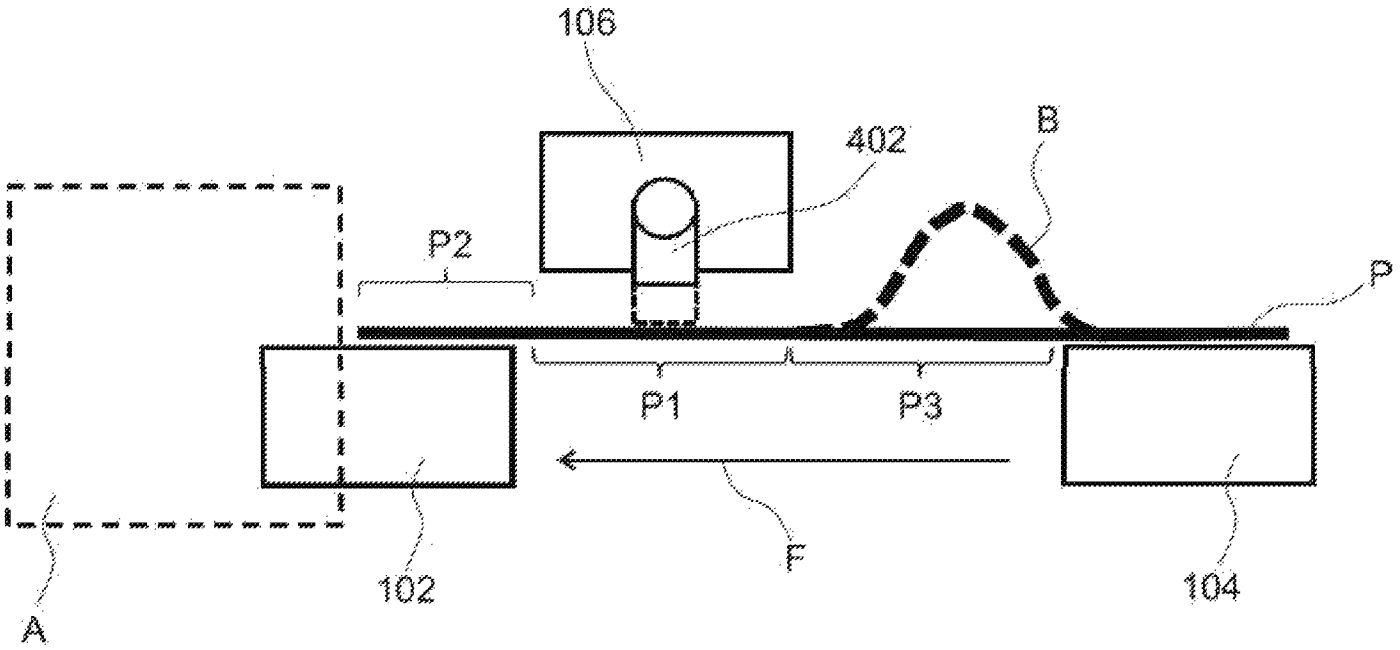
FIG. 4 shows a schematic view of a further example of an apparatus.

FIG. 4 shows a schematic view of yet another example of an apparatus 400. The apparatus 400 is based on the apparatus 100 and comprises a drag device 102, a feed device 104 and a lock device 106. The lock device 106 further comprises a movable stamp member 402 that can protrude from the lock device 106 to fix the printable medium P. In some examples, a stop member (not shown) is provided against which the lock device 106 can abut in order to fix the printable medium P.

The stamp member 402 may be formed by a part of the lock device 106 that is, in a fixation position of the lock device 106, in physical contact with the printable medium P. In particular, the stamp member 402 may be made of a material having a sufficiently high friction coefficient with the surface of the used printable medium P. In some examples, the stamp member 402 is made of an elastomer, such as urethane. In other examples, the stamp member 402 is made of rubber, of silicone, EPDM, Nitrile butadiene rubber (NBR), synthetic rubber, fluoropolymer elastomer, cork, or a combination thereof.

The stamp member 402 may be coupled to a mechanism (not shown) that extracts and retracts the stamp member 402 from and into the lock device 106. The lock device 106 may comprise a housing member for housing the stamp member 402. In some examples, the stamp member 402 is coupled to a spring member (not shown) abutting against the lock device 106. The spring member may be used to exert a spring force on the lock device 106 in order to extract the stamp member 402 from the lock device 106.

In the example shown in FIG. 4, the stamp member 402 is moved towards the printable medium P so as to press on a first port P1 of the printable medium P and thereby fix it. While the first port on P1 is fixed by the stamp member 402, the feed device 104 continues or starts feeding the printable medium P such that the buffer B is created and inflated. The corresponding fixation position of the stamp member 402 is indicated by dashed lines.

While cutting the printable medium P, the stamp member 402 is may be detached from the first portion P1 and the printable medium P, as indicated by solid lines in FIG. 4. As a result, the drag device 102 can convey the printable medium P towards the printing area A, the course of which the buffer B deflates.

Figure 5:
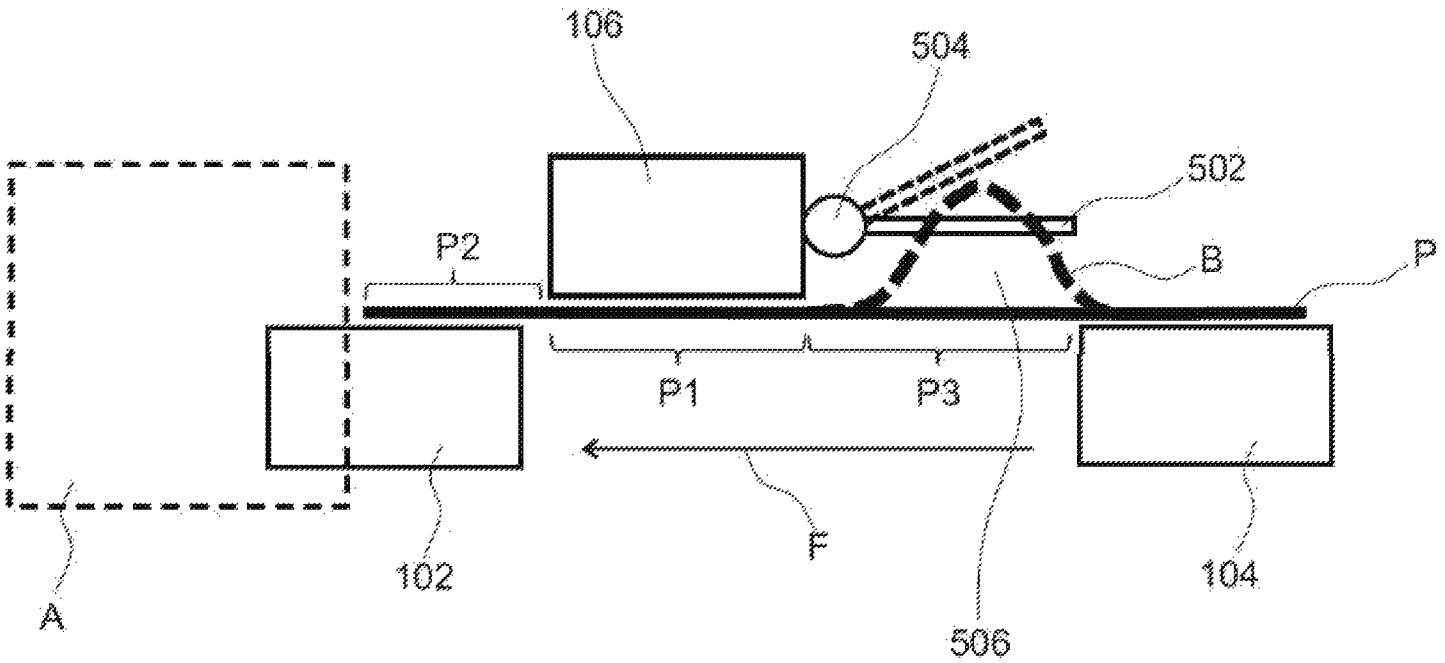
FIG. 5 shows a schematic view of a further example of an apparatus.

FIG. 5 shows a schematic view of a further example of an apparatus 500. The apparatus 500 comprises the features of the apparatus 100 as shown in FIG. 1. In addition, the apparatus 500 comprises a baffle member 502 hinged to the lock device 106 by means of a pivot pin. In other words, the baffle member 502 is articulated to the lock device 106. When the printable medium P is fed towards the drag device 102, the baffle member 502 is in a horizontal position and forms a passage 506 from the feed device 104 to the drag device 102 for the printable medium P. Accordingly, the baffle member 502 guides the printable medium P towards the printing area A.

When the buffer B inflates in response to the fixation of the first portion P1 of the printable medium P by the lock device 106 while the feed device 104 is operating, the inflating buffer B pushes the baffle member 502 from below. As a result, the baffle member 502 is pivoted upwards, thereby providing space for the buffer B, as is shown by dashed lines in FIG. 5.

Figure 6:
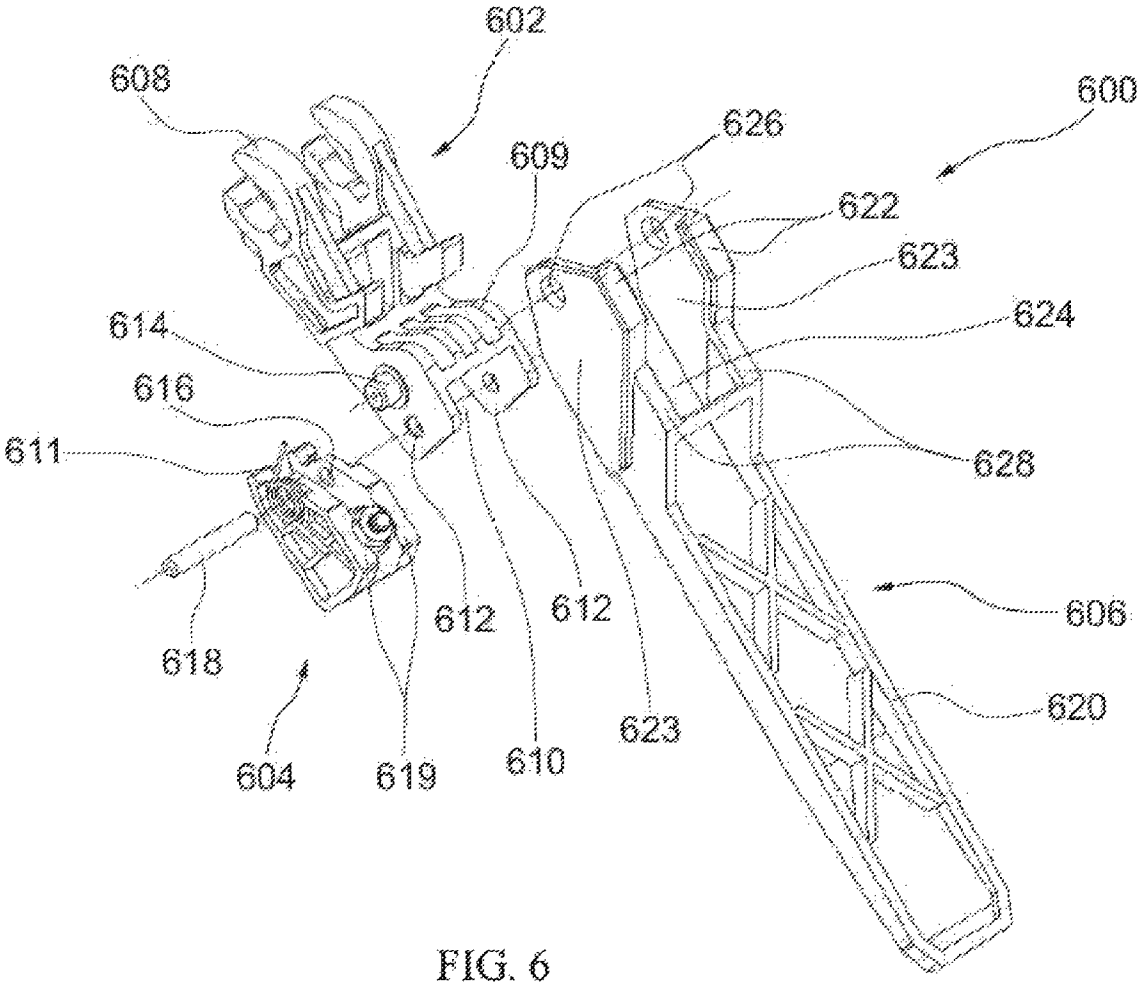
FIG. 6 shows a perspective view of an example of a lock device.

FIG. 6 shows a perspective view of a more detailed example of a lock device 600. The lock device 600 comprises a support member 602, a lock member 604 and a baffle member 606. The support member 602 is to be fixed to a driver shaft of a printer. The lock member 604 and the baffle member 606 are articulated to the support member 602.

The support member 602 comprises an engagement member 608 and a connection portion 609. The engagement member 608 can engage with a driver shaft. In particular, the engagement member 608 is shaped so as to form-fit to the driver shaft. In this regard, the driver shaft may comprise a further engagement member (not shown) that, when engaged, forms a releasable latch connection with the engagement member 608. The connection portion 609 comprises a recess portion 610 that is open to one side. The connection portion 609 further comprises a pair of through holes 612 aligned along an axis and a pair of protruding pins 614 opposite to each other.

The lock member 604 comprises a through hole 616. In particular, the through hole 616 has the same diameter as the pair of through holes 612 of the support member 602. The recess portion 610 of the support member 602 is shaped such as to receive part of the lock member 604. A pin 618 is inserted through the through bole 616 of the lock member 604 and the pair of through holes 612 of the support member 602, thereby articulating the lock member 609 to the support member 602 by means of a hinged connection. The connection portion 609 and the recess portion 610 are shaped such that the lock member 604 can pivot within the recess portion 610. Further, the lock member 604 may include a spring member 611 arranged such as to bias the lock member 604 towards the support member 602 in the recess portion 610.

The baffle member 606 has a guide portion 620 and a head portion 622. The guide portion 620 has an elongated shape to guide the printable medium P. The head portion 622 has two opposite walls 623 enclosing a recess portion 624. Two through holes 626 are formed in the opposite walls 623. The recess portion 624 receives part of the support member 602. The through holes 626 respectively receive one of the protruding pins 614. With the protruding pins 614 engaged in the through holes 626, the baffle member 606 is articulated to the support member 602.

Figure 7:
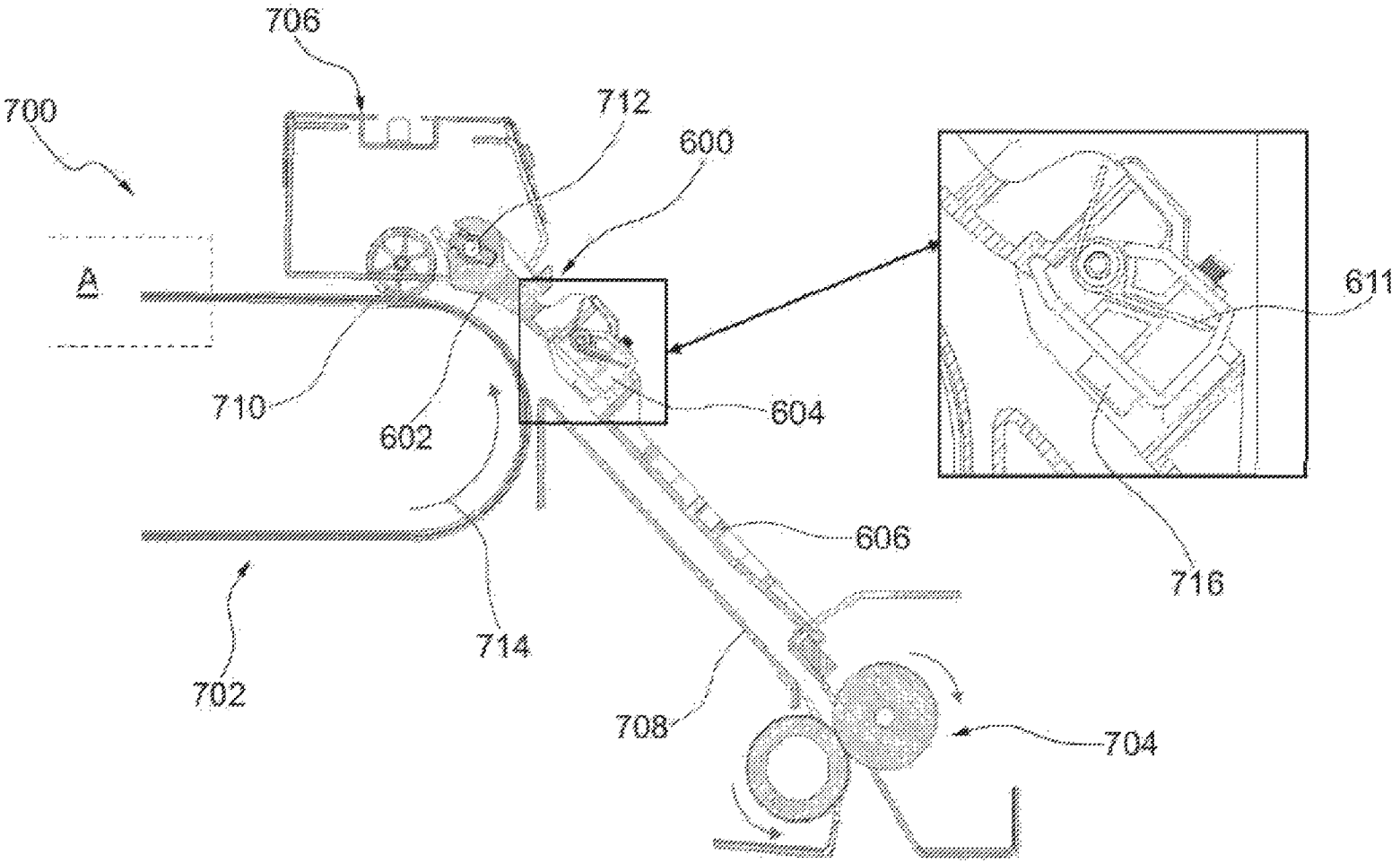
FIG. 7 shows a cross-sectional view of a further example of an apparatus in a first position.

FIG. 7 shows a cross-sectional view of a further example of an apparatus 700 in a first position. The apparatus 700 comprises the lock device 600 as shown in FIG. 6. The apparatus 700 further comprises a conveyor belt 702, a feed device 704, a housing 706, a bottom plate 708, a guide roller 710 and a driver shaft 712. A printing area A is indicated by dashed lines.

The conveyor belt 702 is an example of the drag device 102 as described above. The conveyor belt 702 revolves and thereby drags the printable medium (not shown in FIG. 7) towards the printing area A. The direction of the revolution of the conveyor belt 702 is indicated by an arrow 714. In order to increase a drag force of the conveyor belt 702, the conveyor belt may be provided with openings connected to a vacuum source (not shown). Accordingly, a suction force may be established between the conveyor belt 702 and the printable medium P that is in contact with the conveyor belt 702, for example the second portion P2. In addition to the friction between the printable medium P and the surface of the conveyor belt 702, the suction force may hence contribute to the adhesive strength therebetween.

The feed device 704 is an example of the feed device 104 as described and schematically shown above. The feed device 704 comprises a first roller and a second roller arranged in physical contact with each other, such as to form a nip in between. In some examples, the first roller is connected to a driver (not shown) so as to be driven actively, and the second roller is mounted in a freely rotatable manner to revolve in reaction to the first roller revolving. In particular, the feed device 704 can be accelerated and stopped.

The lock device 600 is connected to the driver shaft 712 by engaging a first engagement member of the lock device 600 with a second engagement member of the driver shaft 712. The first engagement member of the lock device 600 may correspond to the engagement member 608 as shown in FIG. 6. The lock member 604 comprises a pad 716 facing the bottom plate 708. The pad 716 may correspond to the stamp member 402 as shown in FIG. 4.

The guide roller 710 is rotatably attached to the housing 706. Hence, the guide roller 710 may roll in reaction to the revolution of the conveyor belt 702. The guide roller 710 presses printable medium P onto the conveyor belt 702, thereby holding the printable medium. P stable on the surface of the conveyor belt 702.

The apparatus 700 is installed inside or at least connected to a printer (not shown). The printer is provided with a paper roll providing paper as the printable medium P in a continuous manner. The printer comprises a cutter device (not shown) that is disposed between a paper container (not shown) and the feed device 704. The cutter device may correspond to the cutter device as described above.

In FIG. 7, the driver shaft 712 is in a first position such that the lock device 600 is in a guide position. In this position, the lock device 600, namely the support member 602, the lock member 604 and the baffle member 606 are aligned along a common line. In a central position of the lock device 600, the lock device 600 forms, together with the bottom plate 708, a passage for the printable medium P from the feed device 704 to the conveyor belt 702.

Figure 8:
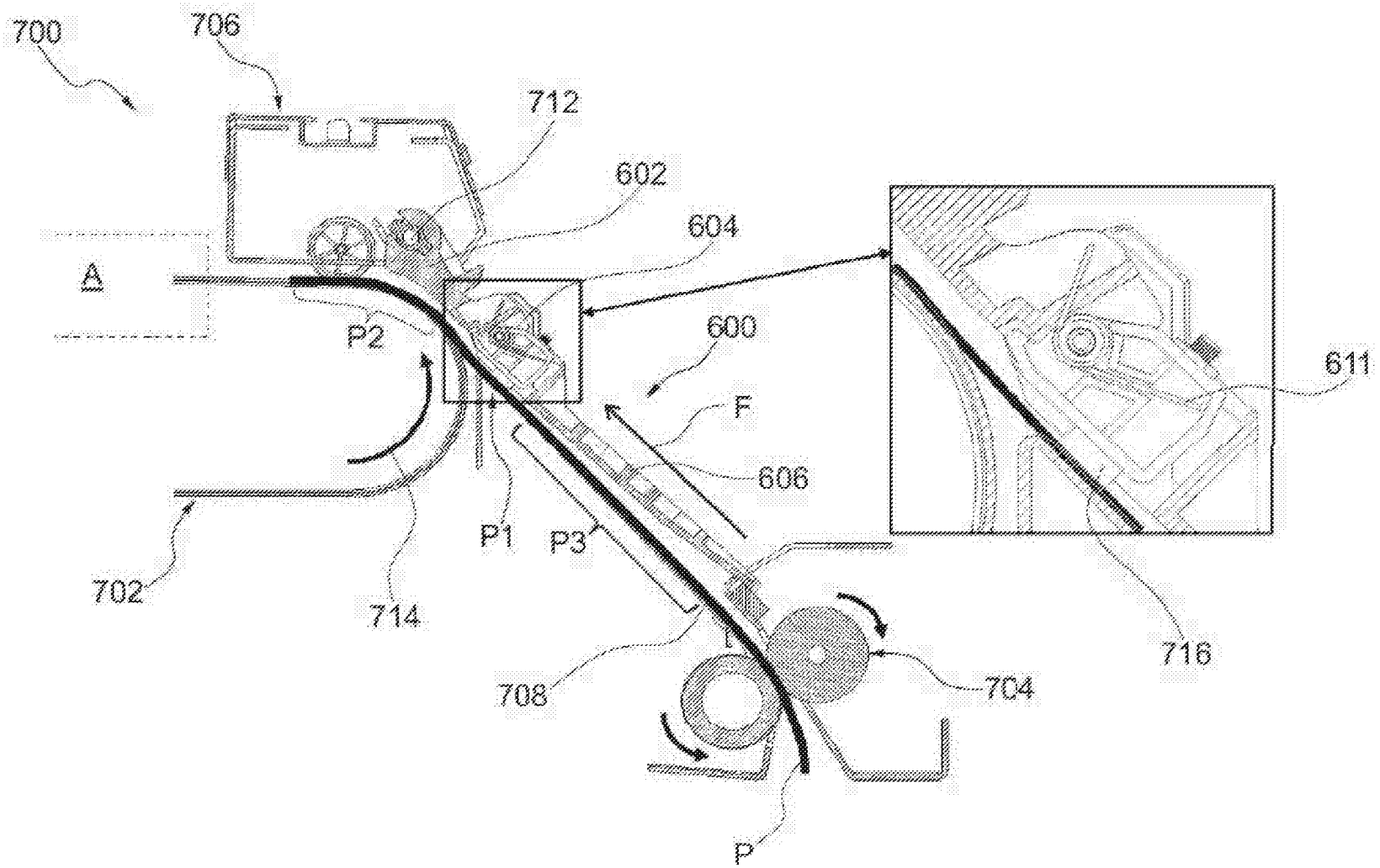
FIG. 8 shows a cross-sectional view of the apparatus of FIG. 7 in a further position.

FIG. 8 shows a cross-sectional view of the apparatus 700 of FIG. 7 with the driver shaft 712 in a second position. In FIG. 8, the driver shaft 712 is rotated clockwise as compared to the first position as shown in FIG. 7. As a result, the support member 602 of the lock device 600, which is engaged with the driver shaft 712, is pivoted by the same angle towards the bottom plate 708. The lock member 604, which is articulated to the support member 602, abuts against the bottom plate 708 such as to be arranged parallel to the bottom plate 708. The spring member 611 presses the lock member 604 towards the bottom plate 708, thereby fixing the printable medium P in a first portion P1. The lock device 600 is therefore in a hold position. As a result, a second portion P2 of the printable medium, which is downstream of the pad 716 and in contact with the conveyor belt 702, cannot follow the conveyor belt 702, but only slips along the conveyor belt 702 instead.

Furthermore, a portion of the lock member 604, e.g. a lock portion 619, abuts against a portion of the baffle member 606, e.g. a strike portion 628, when the lock device 600 is pivoted upwards. In the hold position, the lock portion 619 abuts against the strike portion 628, thereby rifling the baffle member 606 and thus preventing it from touching the bottom plate 708 or the printable medium P. In other examples, a further lock portion (not shown) abuts against another strike portion of the baffle member 606 in order to space the baffle member 606 from the bottom plate 708 when the lock device 600 is in the guide position.

Figure 9:
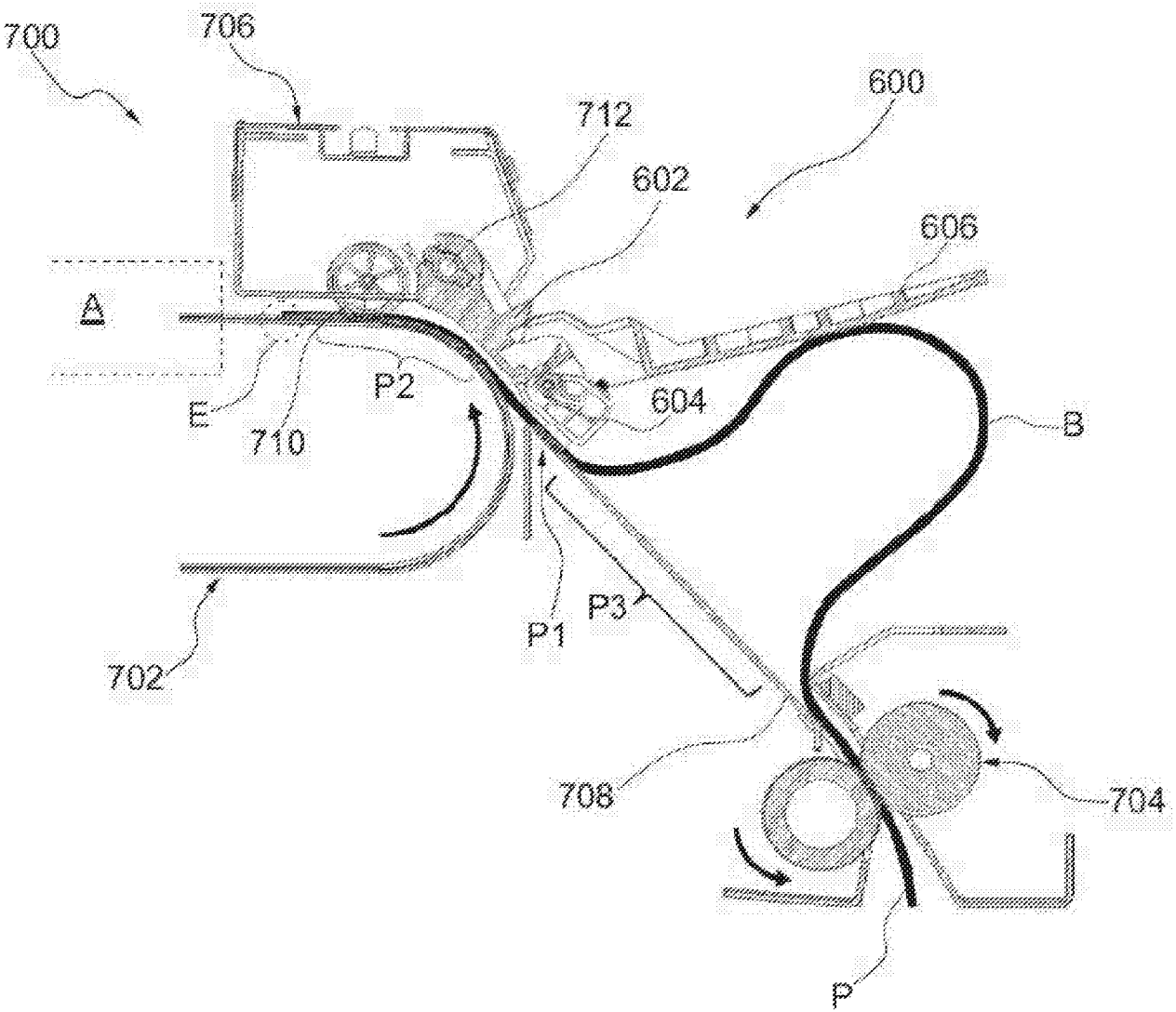
FIG. 9 shows a cross-sectional view of the apparatus of FIG. 7 in a further position.

FIG. 9 shows a cross-sectional view of the apparatus 700 with the driver shaft 712 in the second position as shown in FIG. 8 and the baffle member 606 being pivoted upwards by a buffer B of the printable medium P. The driver shaft 712 is in the lower position as shown in FIG. 8. The support member 602 is in the corresponding lower position, thereby pressing the lock member 604 against the bottom plate 708. Hence, the first portion P1 remains being fixed by the pad 716. The baffle member 606 can be pivoted by inflating buffer B. The lock device 600 is in a buffering position.

While the first portion P1 of the printable medium P being fixed, the feed device 704 keeps feeding the printable medium towards the printing area A. As a result, the printable medium P is accumulated in the third portion P3 upstream of the pad 716. The accumulated printable medium P in the third portion P3 of the printable medium P forms and expands the buffer B. As the buffer B grows, the articulate baffle member 606 is pushed and pivoted upwards by the buffer B.

Figure 10:
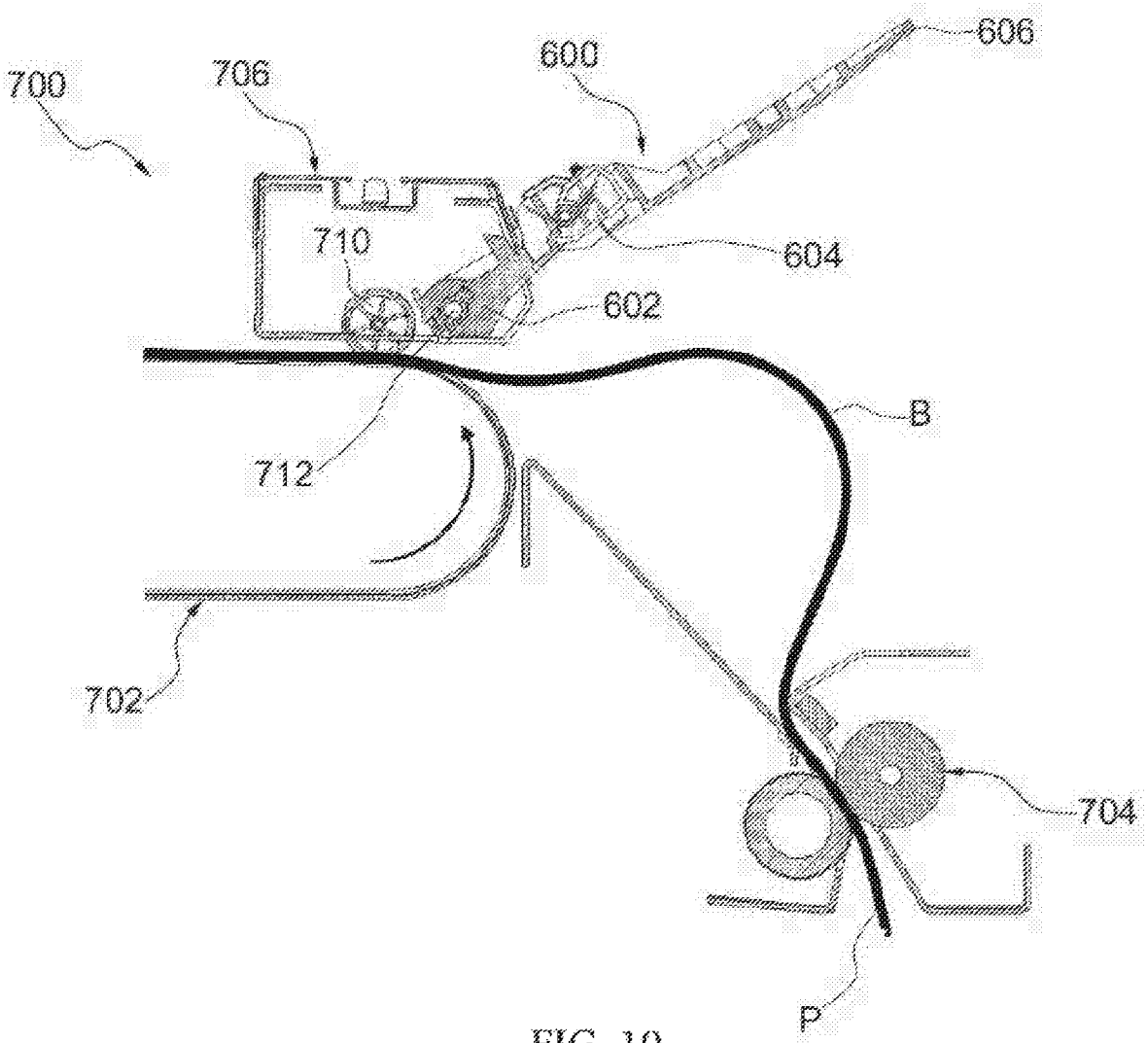
FIG. 10 shows a cross-sectional view of the apparatus of FIG. 7 in a further position.

FIG. 10 shows a cross-sectional view of the apparatus 700 with the driver shaft 712 in a third position. The driver shaft 712 has changed from the lower position as shown in FIGS. 8 and 9 to an upper position by rotating counter-clockwise, thereby lifting the support member 602 of the lock device 600. When rotating counter-clockwise, the support member 602 abuts against the lock member 604 and the lock member 604 abuts against the baffle member 606. As a result, the support member 602, the lock member 604 and the baffle member 606 together rotate counter-clockwise in a linearly aligned manner. The lock device 600 is in a release position. With the printable medium P not being fixed by the lock device 600, the printable medium P can be dragged by the conveyor belt 702 into the printing area A. The feed device 704 stops rolling and the printable medium P is cut according to the page to be printed. The buffer B deflates as the printable medium P is pulled or dragged towards the printing area A. The lock device 600 is maintained in the release position to allow for the next page to advance towards the printing areas as indicated by the feed direction F. After that, the lock device 600 is switched to the lock position again to fix a next first portion P1 of the printable medium P.

Figure 11:
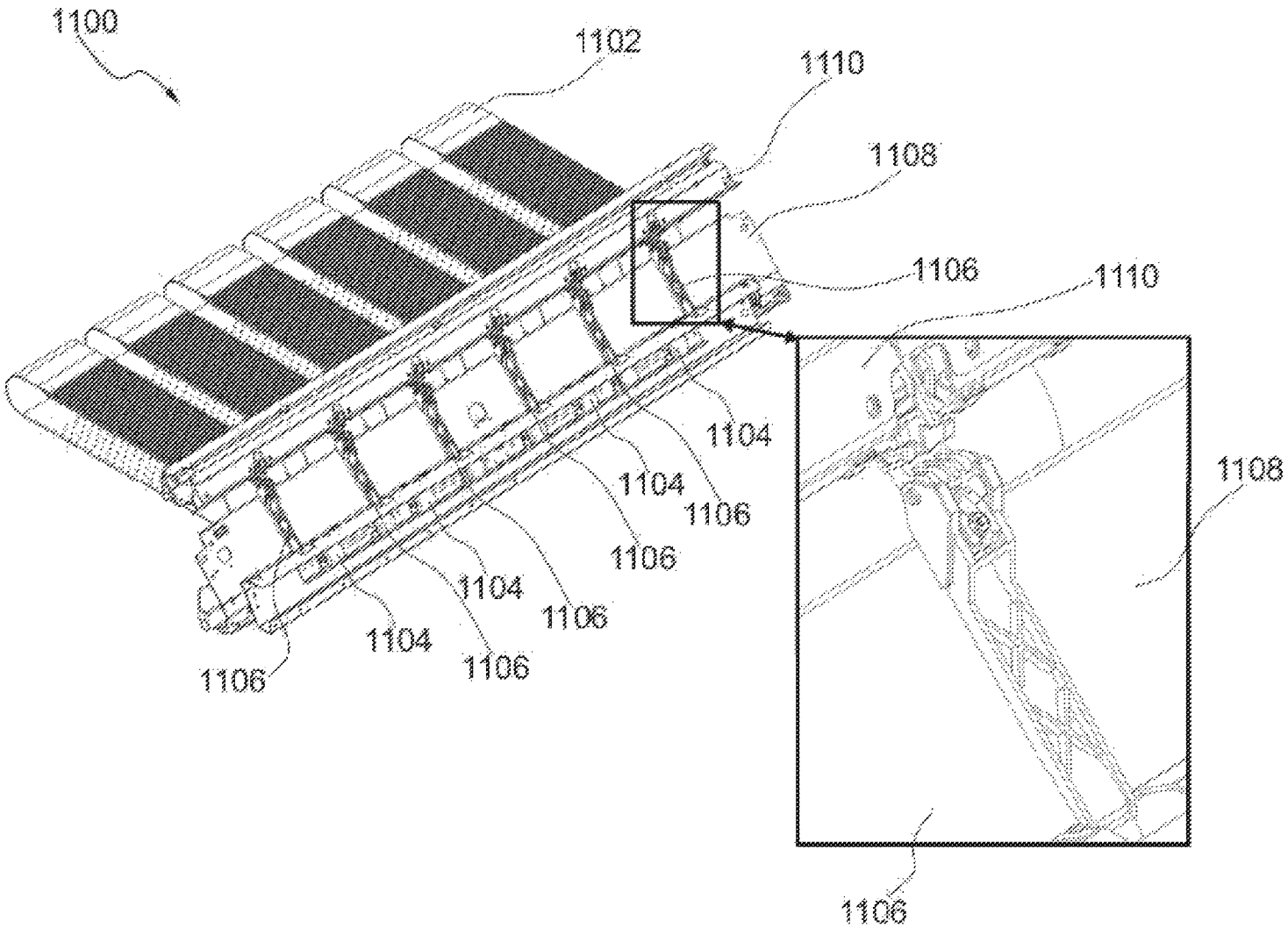
FIG. 11 shows a perspective view of another example of a printer.

FIG. 11 shows a perspective partial view of a printer 1100. The printer 1100 comprises a conveyor belt 1102, a feed device 1104 and a plurality of lock devices 1106. For example, the apparatus 700 may be integrated in the printer 1100. The plurality of lock devices 1106 is arranged parallel to one another. A passage for the printable medium P is formed between the plurality of lock devices 1106 and a bottom plate 1108. The plurality of lock devices 1106 is operatively coupled to a control shaft that is housed in a housing portion 1110 of the printer 1100.

The conveyor belt 1102 has openings, indicated as solid dots in FIG. 11, that are connected to a vacuum source, thereby causing a suction force on the printable medium P towards the conveyor belt 1102. The shaded area on the conveyor belt 1102 may correspond to a printing area A of the printer 1100.

Figure 12:
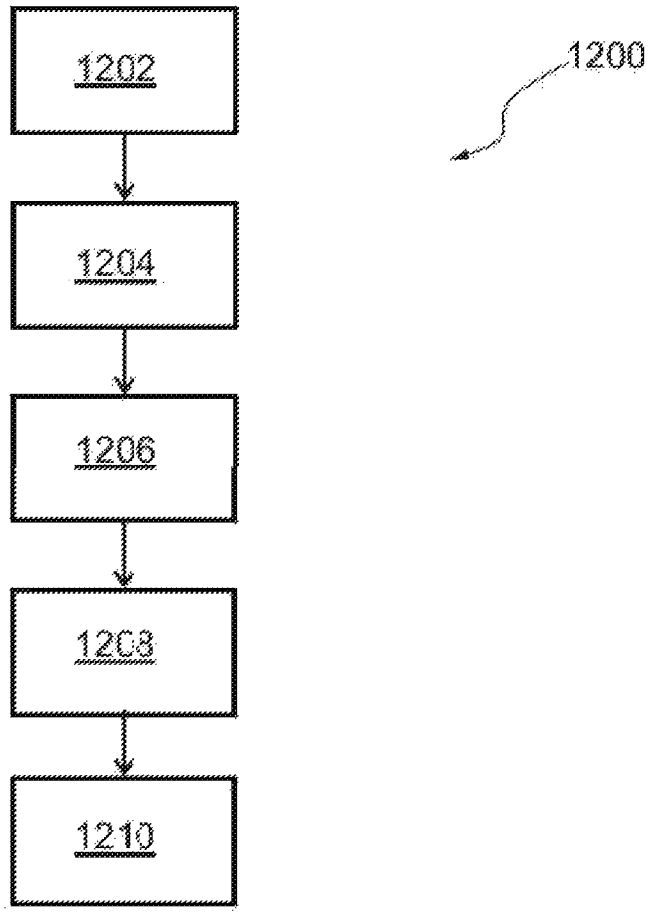
FIG. 12 shows a flow chart of a method for manipulating a printable medium.

FIG. 12 shows a flow diagram of a method 1200 for manipulating a printable medium to be printed in a printing area. In particular, the method 1200 may be implemented for the use of any of the apparatuses 100, 300, 400, 500, 700 or the printer 1100 as described above in connection with the drawings. The printable medium may correspond to the printable medium P as described above. The printable medium may be paper. The printing area may correspond to the printing area A as described above.

At block 1202, the printable medium is fed towards the printing area using a feed device. The feed device may correspond to any of the feed devices 104, 704 as described above.

At block 1204, the printable medium is dragged into the printing area using a drag device. The drag device may correspond to any of the drag devices 102 and conveyor belt 702 as described above.

At block 1206, a first portion of the printable medium is temporarily fixed. Consequently, a second portion of the printable medium being in contact with the drag device slips along the drag device, and a buffer of the printable medium in the form of a buckle is formed in a third portion of the printable medium located between the feed device and the lock device. The buffer of the printable medium may correspond to the buffer B as described above.

Further actions may be performed in addition to the blocks 1202-1206 as described above. At block 1208, the first portion of the printable medium is released after the buffer of the printable medium, or the buckle, has expanded to a predetermined degree. The predetermined degree may correspond to an amount of the buffer consumed within the duration of the cutting process. In another example, the predetermined degree corresponds to a fixed size of the buffer or a fixed time period of buffering, after reaching which the printable medium is to be released.

At block 1210, the printable medium is cut according to an image to be printed in response to releasing the first portion.

REFERENCE SIGNS

100 apparatus
102 drag device
104 feed device
106 lock device
200 printer
202 supply device
204 cutter device
300 apparatus
302 driver shaft
304 support member
400 apparatus
402 stamp member
500 apparatus
502 baffle member
504 pivot pin
600 lock device
602 support member
604 lock member
606 baffle member
608 engagement member
609 connection portion
610 recess portion
611 spring member
612 through hole
614 protruding pin
616 through hole
618 pin
619 lock portion
620 guide portion
622 head portion
623 wall
624 recess portion
626 through hole
628 strike portion
700 apparatus
702 conveyor belt
704 feed device
706 housing
708 bottom plate
710 guide roller
712 driver shaft
714 drag direction
716 pad
1100 printer
1102 feed device
1104 conveyor belt
1106 lock device
1108 bottom plate
1110 housing
1200 method
1202-1210 block
A printing area
B buffer/buckle
E leading edge
F flow/feed direction
P printable medium
P1 first portion of the printable medium
P2 second portion of the printable medium
P3 third portion of the printable medium

The invention claimed is:

1. An apparatus, comprising:
a drag device to convey a printable medium to a printing area;
a feed device to feed the printable medium to the drag device; and
a lock device disposed between the feed device and the drag device to temporarily fix a first portion of the printable medium so as to cause a second portion of the printable medium being in contact with the drag device to slip along the drag device, and to form a buckle in a third portion of the printable medium located between the feed device and the lock device.

2. The apparatus of claim 1, further comprising:
a baffle member hinged to the lock device to form a passage for the printable medium between the feed device and the drag device, and to be pivoted by the buckle formed by the lock device.

3. The apparatus of claim 1, wherein:
the lock device comprises a pad to press on the first portion of the printable medium in order to fix the same.

4. The apparatus of claim 3, wherein:
the lock device comprises a housing member to house the pad such that the pad protrudes from the housing member such as to press on the printable medium in order to, fix the first portion of the printable medium.

5. The apparatus of claim 3, wherein:
the pad is made of an elastomer.

6. The apparatus of claim 1, further comprising:
a control device to control the feed device so as to feed the printable medium in a discontinuous manner, thereby providing an interruption interval for upstream processing of the printable medium without delaying downstream conveying of the printable medium by the drag device.

7. The apparatus of claim 1, further comprising:
a driving shaft to drive the lock device such as to switch between a release position and a fixation position, wherein the lock device is fixed to or operatively coupled with the driving shaft.

8. The apparatus of claim 1, further comprising:
the drag device comprises a conveyor belt to drag the printable medium into the printing area.

9. The apparatus of claim 8, wherein:
the conveyor belt comprises openings connected to a vacuum source to establish a suction force between the conveyor belt and the second portion of the printable medium.

10. An apparatus, comprising:
a drag device to convey a printable medium to a printing area;
a feed device to feed the printable medium to the drag device;
a lock device disposed between the feed device and the drag device to temporarily fix a first portion of the printable medium so as to cause a second portion of the printable medium being in contact with the drag device to slip along the drag device, and to form a buckle in a third portion of the printable medium located between the feed device and the lock device; and a driving shaft to drive the lock device such as to switch between a release position and a fixation position, wherein the lock device is fixed to or operatively coupled with the driving shaft;

wherein:

the driving shaft comprises a first engagement member, the lock device comprises a second engagement member, and when brought into engaging with each other, the first and second engagement members form a releasable latch connection.

11. The apparatus of claim 10, wherein:

the second engagement member comprises a recess portion, and the first engagement member comprises a protruding portion to be received in the recess portion.

12. The apparatus of claim 11, wherein:

the protruding portion exerts a driving torque from the driving shaft to the lock device in order to drive the lock device.

13. A printer to print on a printable medium in a printing area, comprising:

a conveyor belt to drag the printable medium into the printing area;

a feed device to feed the printable medium;

a lock device disposed between the feed device and the conveyor belt to temporarily fix a first portion of the printable medium during feed so as to cause a second portion of the printable medium being in contact with the conveyor belt to slip along the conveyor belt, and to accumulate the printable medium in a third portion of the printable medium located between the feed device and the lock device;

a supply device to supply the printable medium, wherein the printable medium is a continuous printable medium; and a cutter device disposed upstream of the feed device to cut the printable medium according to an image to be printed thereon;

wherein the lock device releases the first portion of the printable medium in response to the accumulated printable medium expanding to a predetermined degree, the feed device stops feeding the printable medium and the cutter device cuts the printable medium.

14. A method for manipulating a printable medium to be printed in a printing area, comprising:

feeding the printable medium towards the printing area using a feed device;

dragging the printable medium into the printing area using a drag device;

temporarily fixing a first portion of the printable medium using a lock device, thereby causing:

a second portion of the printable medium being in contact with the drag device to slip along the drag device; and a buckle being formed in a third portion of the printable medium located between the feed device and the lock device.

15. The method of claim 14, further comprising:

releasing the first portion of the printable medium after the buckle has expanded to a predetermined degree; and in response to releasing, cutting the printable medium according to an image to be printed.

* * * * *